US008789501B2

(12) United States Patent
Bosel

(10) Patent No.: US 8,789,501 B2
(45) Date of Patent: Jul. 29, 2014

(54) DEVICE FOR VARYING THE CONTROL TIMES OF GAS EXCHANGE VALVES OF AN INTERNAL COMBUSTION ENGINE

(75) Inventor: Christian Bosel, Rednitzhembach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 70 days.

(21) Appl. No.: 13/522,194

(22) PCT Filed: Jan. 12, 2011

(86) PCT No.: PCT/EP2011/050342

§ 371 (c)(1),
(2), (4) Date: Jul. 13, 2012

(87) PCT Pub. No.: WO2011/092055

PCT Pub. Date: Aug. 4, 2011

(65) Prior Publication Data

US 2013/0055975 A1 Mar. 7, 2013

(30) Foreign Application Priority Data

Feb. 1, 2010 (DE) ..... 10 2010 006 415

(51) Int. Cl.
*F01L 1/34* (2006.01)
*F02M 25/00* (2006.01)

(52) U.S. Cl.
USPC ..... 123/90.15; 123/90.17; 123/198 E

(58) Field of Classification Search
USPC ..... 123/90.15, 90.17
See application file for complete search history.

(56) References Cited

U.S. PATENT DOCUMENTS

| | | | | |
|---|---|---|---|---|
| 5,337,711 | A * | 8/1994 | Hampton | 123/90.17 |
| 2008/0190388 | A1* | 8/2008 | Kleiber et al. | 123/90.15 |
| 2010/0089353 | A1* | 4/2010 | Myers et al. | 123/90.17 |
| 2011/0120399 | A1* | 5/2011 | Weber | 123/90.15 |
| 2012/0186547 | A1* | 7/2012 | Fujiyoshi et al. | 123/90.17 |
| 2012/0199473 | A1* | 8/2012 | Antozzi et al. | 204/242 |
| 2013/0174798 | A1* | 7/2013 | Arnold | 123/90.15 |

FOREIGN PATENT DOCUMENTS

| | | | |
|---|---|---|---|
| DE | 19903624 | | 8/1999 |
| DE | 10 2007 039282 | | 2/2009 |
| DE | 102009005114 | | 8/2009 |
| DE | 102008001078 | | 10/2009 |
| DE | 102008001078 | A1 * | 10/2009 |
| WO | 2007082600 | | 7/2007 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

A device (1) for varying the control times of gas exchange valves of an internal combustion engine having a stator (3) and a rotor (5) accommodated therein. The rotor (5) can be connected to a camshaft and can be adjusted by a pressure medium in the circumferential direction relative to the stator (3). The device (1) further includes a front cover disk (7) and a rear cover disk (9), between which the stator (3) and the rotor (5) are accommodated. The rear cover disk (9) is provided with a drive wheel (11) that can be connected to a crankshaft. A spring (13) for rotating the rotor (5) relative to the stator (3) is arranged between the rear cover disk (9) and a spring cover (15), wherein the spring cover (15) is positively connected to the drive wheel (11), whereby simple installation of the spring cover (15) on the device (1) is made possible.

11 Claims, 3 Drawing Sheets

DEVICE FOR VARYING THE CONTROL TIMES OF GAS EXCHANGE VALVES OF AN INTERNAL COMBUSTION ENGINE

FIELD OF THE INVENTION

The invention relates to a device for varying the timing of gas exchange valves of an internal combustion engine, comprising a stator and a rotor accommodated therein, which is adjustable in a circumferential direction relative to the stator by means of a pressure medium, wherein the rotor can be connected to a camshaft, further comprising a front cover disk and a rear cover disk, between which the stator and the rotor are accommodated, wherein the rear cover disk is provided with a drive wheel that can be connected to a crankshaft, and a torsion spring for rotating the rotor relative to the stator. A camshaft adjusting device of identical construction is known from DE 10 2009 005 114 A1.

BACKGROUND

In modern internal combustion engines, devices for varying the timing of gas exchange valves are used to enable the phase relation between the crankshaft and the camshaft to be configured in a variable manner within a defined angular range, between a maximum advance and a maximum retardation position. For this purpose, the device is integrated into a drive train, via which a torque is transmitted from the crankshaft to the camshaft. This drive train can be embodied as a belt, chain or gearwheel drive, for example. Such a device generally comprises an output element (rotor), which is arranged so as to be rotatable relative to an input element (stator), wherein the stator is in driven connection with the crankshaft and the rotor is connected to the camshaft for conjoint rotation.

According to DE 10 2009 005 114 A1, the concentric arrangement of the stator and the rotor is bounded axially by two cover disks. The stator, the rotor and the two cover disks bound a plurality of pressure spaces, each of the pressure spaces being divided into two oppositely acting pressure chambers by means of a vane. By supplying pressure medium and discharging pressure medium to and from the pressure chambers, the vanes are moved within the pressure spaces, thereby bringing about a specific rotation of the rotor relative to the stator and thus of the camshaft relative to the crankshaft.

In order to move the rotor back into a rest or initial position relative to the stator, springs are sometimes also used. Flat spiral torsion springs are often used, typically being secured on the rotor and on the stator by means of pins or screws.

To ensure that the spring does not jump out of the holder provided during operation, a spring cover is provided to fix the spring. In DE 10 2009 005 114 A1, the spring is arranged between the spring cover and a front cover disk, wherein a plurality of bolts pass through the spring cover, the front cover disk, the stator and the rear cover disk. Depending on costs and function, spring covers are predominantly manufactured from steel sheet or from plastic. In order to be able to perform their function, it is particularly important that they do not come away from the device under the operating loads which occur.

SUMMARY

It is the underlying object of the invention to allow simple and reliable mounting of a spring cover on a device for varying the timing of gas exchange valves.

According to the invention, the object is achieved by a device for varying the timing of gas exchange valves of an internal combustion engine, comprising a stator and a rotor accommodated therein, which is adjustable in a circumferential direction relative to the stator by means of a pressure medium, wherein the rotor can be connected to a camshaft, further comprising a front cover disk and a rear cover disk, between which the stator and the rotor are accommodated, wherein the rear cover disk is provided with a drive wheel that can be connected to a crankshaft, and a torsion spring for rotating the rotor relative to the stator, wherein the spring is arranged between the rear cover disk and a spring cover, and wherein the spring cover is secured on the front side of the drive wheel.

The invention starts from the consideration that simple fastening of the spring cover on the device is ensured by means of a positive connection of the spring cover to the front side of the drive wheel, namely to the front side facing the spring cover. The term "rear cover disk" is preferably applied to the cover disk which faces the camshaft or from which the camshaft extends axially. In this case, the drive wheel is, for example, a belt pulley, a chain sprocket or a gearwheel and lies in one plane with the rear cover disk. The drive wheel, which extends further radially than the other components of the device, offers a sufficient surface on which to mount the spring cover. The advantage here is that, by virtue of the connection on the front side, the size of the spring cover is set to a required minimum to reach around the spring. Moreover, there is no need for any design modifications to the drive wheel, e.g. an axial displacement of the drive wheel relative to the rear cover disk, in order to form a fastening surface at the circumference. There is likewise no need for any modifications to the construction and arrangement of the other components of the device. The fastening of the spring cover takes place independently of the fastening of the cover disks on the stator and is performed in a simple manner in a separate step. In particular, the spring is arranged directly between the rear cover disk or drive wheel and the spring cover. In this arrangement, the spring cover is of approximately cup-shaped configuration, thus bounding the spring axially on one side and reaching around it in a circumferential direction. Mutually corresponding fastening elements are provided on the drive wheel and on the spring cover, engaging in one another and thus producing a connection, in particular a positive connection, between the spring cover and the drive wheel. These fastening elements are provided exclusively for fastening the spring cover and are matched to the corresponding requirements.

Latching elements are preferably provided on the spring cover, and receptacles for the latching elements are preferably provided on the drive wheel, with the aid of which a snap joint is produced between the spring cover and the drive wheel. The snap joint is produced by guiding the latching elements through the elongate holes from the inside outward, i.e. from a drive wheel side facing the camshaft to a drive wheel side facing away from the camshaft, allowing the latching elements to engage on the outside. A snap joint offers a number of advantages, e.g. the latching elements are formed in the same production step as the spring cover, in particular integrally therewith, and the latching elements have a relatively simple geometry, with no further fixing elements, such as adhesives, solvents, welding or special devices being required. The receptacles are provided on the drive wheel in a manner corresponding to the latching elements on the spring cover, said receptacles preferably being designed as elongate holes. In particular, the elongate holes follow a circular arc but, as an alternative, can also be of straight design. Elongate holes are distinguished by the particularly simple shape and production thereof. The design of the receptacles in the manner of elongate holes allows an elongate shape of the latching elements, thus ensuring that the loads which they bear are distributed over a larger area.

According to a preferred embodiment, the latching elements comprise a radial latching hook for radial engagement with the drive wheel. The engaged radial latching hook extends outward, in particular radially outward, in relation to the elongate hole, with the result that the radially outer edge is overlapped by the radial latching hook. To ensure that the radial latching hook does not break during assembly, it advantageously overlaps a contour of the receptacle by no more than 1 mm. The size of the radial latching hook and hence the size of the overlapped contour of the elongate hole varies in accordance with the size of the spring cover, the magnitude of the spring force and the number of latching elements.

According to another preferred embodiment, the latching elements comprise a tangential latching hook for engagement with the drive wheel in a circumferential direction. In use, the spring cover is exposed to temperatures in a range of from −40° C. to +130° C. The thermal expansion of the spring cover in the higher temperature range may lead to deformation of the radial latching hooks resting against the edge of the elongate holes. When cold, after the spring cover has shrunk again, there is the risk that the spring cover will no longer engage radially. This risk is counteracted by the fact that the tangential latching hooks ensure retention of the spring cover in a circumferential direction and thus prevent it from being released.

The radial latching hook is preferably larger than the tangential latching hook, in particular two to five times larger. At the same time, the radial latching hook is of more massive design than the tangential latching hook and bears the principal loads. This means that the forces introduced into the spring cover by the spring are primarily borne by the radial latching hook. The tangential latching hook serves primarily to provide additional security in cold operation, ensuring that the spring cover does not come away from the drive wheel even if the radial latching hook is deformed.

With a view to particularly reliable operation of the device, rotational retention pins are preferably provided on the spring cover, preventing rotation of the spring cover relative to the drive wheel. The rotational retention pins are preferably arranged adjoining the latching elements and extend radially, and therefore both the latching elements and the rotational retention pins are introduced into the elongate holes in the drive wheel. By means of their abutment against the edges of the elongate holes, the rotational retention pins prevent rotation of the cover in a circumferential direction.

According to a preferred variant, each radial latching hook is arranged between a tangential latching hook and a rotational retention pin. The radial latching hook, which has the greatest volume of all the elements introduced into the elongate hole, extends almost all the way along one longitudinal side of the elongate hole and engages behind the edge thereof. The tangential latching hook is arranged on one side of the radial latching hook, and the rotational retention pin is arranged on the other side, the tangential latching hook and the rotational retention pin engaging in the semicircular narrow sides of the elongate hole and fulfilling their function through their interaction with the contour of the elongate hole.

Since only one rotational retention pin is accommodated in each elongate hole, abutting only one side of the elongate hole, this rotational retention pin prevents rotation of the spring cover relative to the drive wheel in only one direction. To ensure rotational retention in both directions, the two rotational retention pins are preferably arranged in mirror symmetry about a radial axis with respect to the radial latching hooks. In particular, the latching elements are grouped in pairs and respective rotational retention pins are arranged to the side of two such latching elements, with one rotational retention pin being positioned to the left and the other rotational retention pin being arranged to the right of the respective latching element. By means of the arrangement of the rotational retention pins in mirror symmetry relative to the latching elements, rotational retention is ensured both in a clockwise and in a counterclockwise direction.

For reasons to do with weight and production engineering, it is expedient if the spring cover is made of plastic. Plastic is a very light material and is furthermore particularly easily formable. The use of plastic furthermore enables the latching elements to be formed integrally with the spring cover. As an alternative, the spring cover is, in particular, a sheet-metal part.

BRIEF DESCRIPTION OF THE DRAWINGS

An embodiment of the invention is explained in greater detail with reference to a drawing, in which.

In the various figures, reference signs which are the same have the same meaning.

DETAILED DESCRIPTION OF THE PREFERRED EMBODIMENTS

Figure 1:
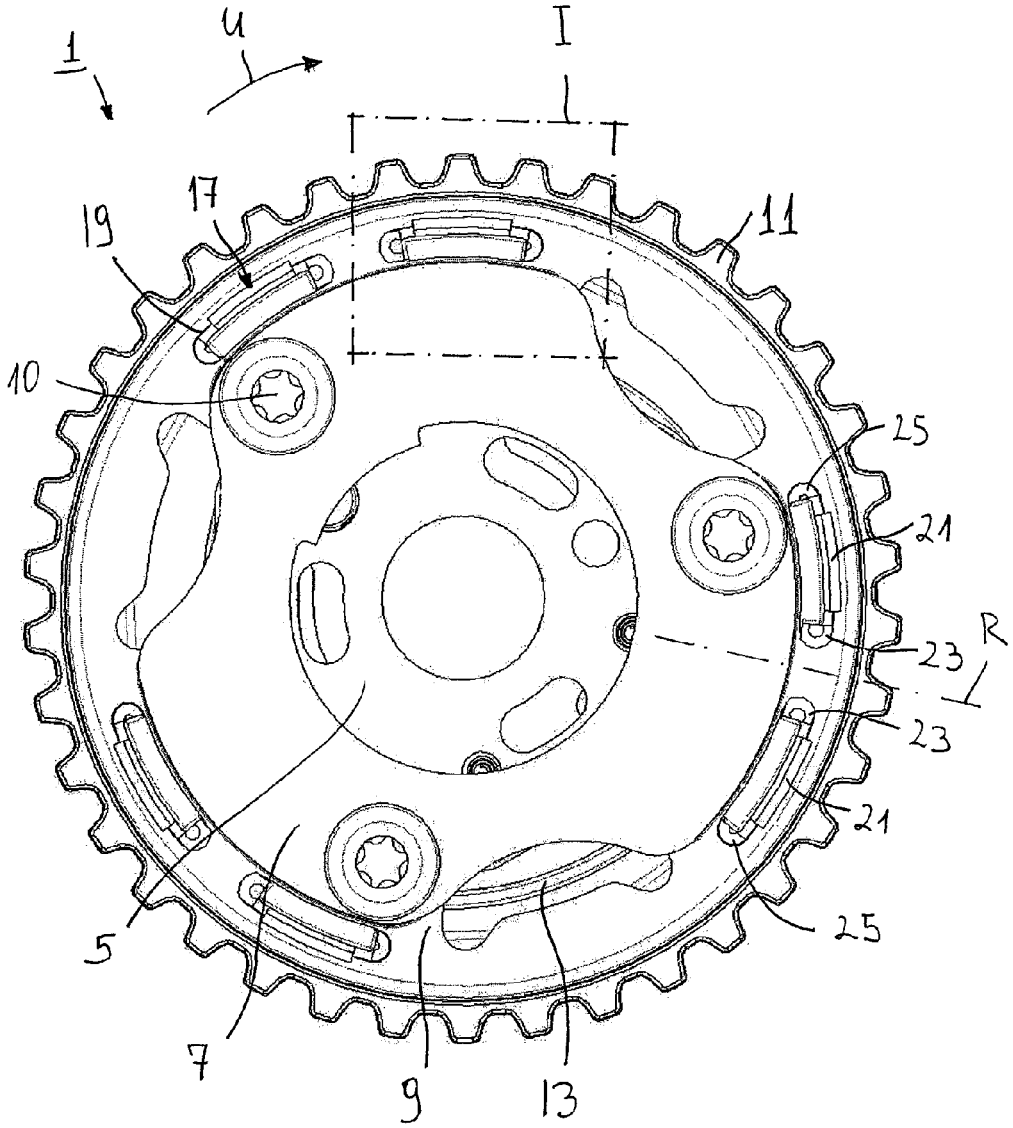
FIG. 1 shows a device for varying the timing of gas exchange valves of an internal combustion engine (not shown specifically) in a front view.

FIG. 1 shows a device 1 for varying the timing of gas exchange valves of an internal combustion engine. The device 1 is provided for mounting on a camshaft (not shown specifically). The camshaft extends rearward in an axial direction, i.e. toward the rear perpendicularly to the plane of the drawing, and therefore FIG. 1 shows a front side or an outer side of the device 1.

The device 1 essentially comprises a stator 3 (see FIG. 3), a rotor 5, a front cover disk 7 and a rear cover disk 9. The stator 3, which is the input element, is connected to a crankshaft (not shown specifically) and is arranged concentrically around the rotor 5, the output element. The rotor 5 is connected to the camshaft for conjoint rotation and is arranged so as to be pivotable relative to the stator 5. The stator 5 and the rotor are accommodated between the front and rear cover disks 7, 9. The two cover elements 7, 9 are screwed to the stator 3 by means of screws 10.

Pressure spaces (not shown) bounded axially by the cover disks 7, 9 are formed between the rotor 5 and the stator 3. With the aid of vanes (likewise not shown here specifically) of the rotor 5, the pressure spaces are divided into two oppositely acting pressure chambers. In order to bring about an angular displacement of the rotor 5 relative to the stator 3, a pressure medium, e.g. oil, is directed into the pressure chambers.

The front cover disk 7 is designed as a sealing cover and serves to seal off the pressure spaces axially. The rear cover disk 9 likewise has a sealing function and, at the circumference, it is furthermore provided with a drive wheel, in this case a belt pulley 11, which can be connected to the crankshaft. The belt pulley lies in the same plane as the rear cover disk 9 and thus represents a radial extension of the rear cover disk 9.

Figure 3:
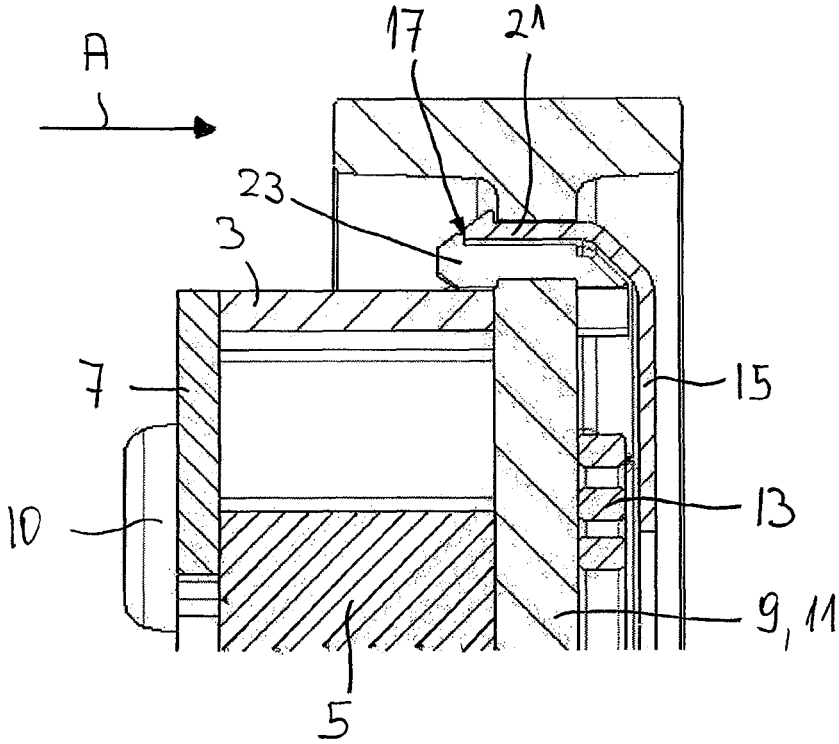
FIG. 3 shows a longitudinal section in an axial direction through the plane II in FIG. 2.
Figure 4:
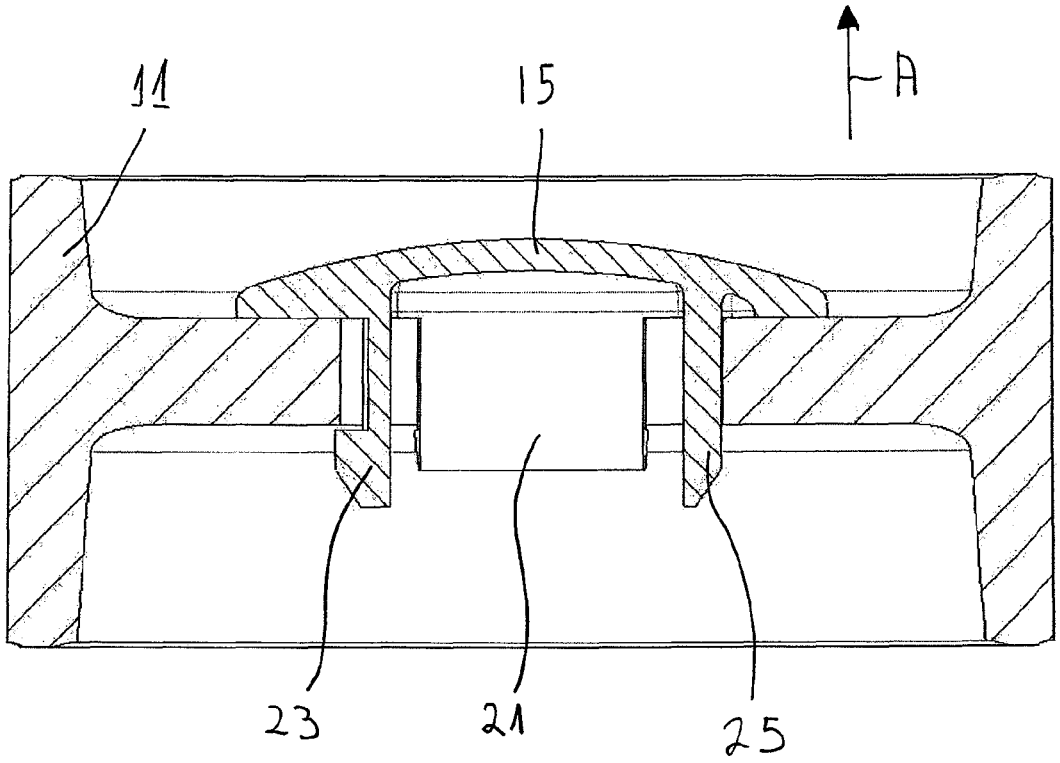
FIG. 4 shows a cross section through the plane III in FIG. 2.

As can be seen from FIG. 3, a spring 13 is provided behind the rear cover disk 9 in axial direction A, said spring bringing the rotor 5 back into a rest or initial position. The spring 13 is positioned between the rear cover disk 9 and the spring cover 15, which is shown in FIG. 3 and FIG. 4. The spring cover 15 bounds the spring 13 axially toward the rear and furthermore surrounds it at the circumference. In the embodiment shown, the spring cover 15 is made of plastic, but it can also be made of metal. Through the use of plastic, it is possible to achieve desired geometric shapes more easily.

The spring cover 15 is secured positively on the front side of the belt pulley 11 by means of latching elements 17. To accommodate the latching elements 17, a plurality of receptacles 19 in the form of elongate holes are formed on the belt pulley 11. In the embodiment shown, each of the latching elements 17 comprises a radial latching hook 21 and a tangential latching hook 23. The radial latching hook 21 is in engagement with a radially outer longitudinal side of the elongate hole 19. The tangential latching hook 23 is arranged laterally with respect to the radial latching hook 21 and has a width which corresponds substantially to the width of the elongate hole 19.

Figure 2:
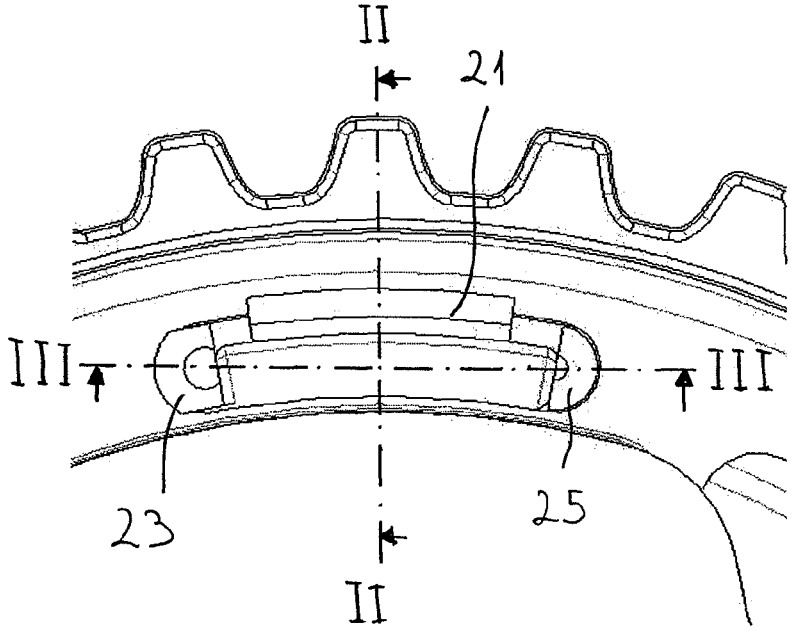
FIG. 2 shows an enlargement of the detail I in FIG. 1.

As can be seen, in particular, from the enlargement of the detail I in FIG. 2, the radial latching hook 21 is of more massive design than the tangential latching hook 23. In the embodiment shown, the radial latching hook 21 is approximately three times larger than the tangential latching hook 23 and bears the principal load. If the spring cover 15 expands during operation at elevated temperatures, the radial latching hook 21 may be deformed and, after cooling, when the spring cover 15 has shrunk again, the radial latching hook 21 may no longer engage. In this case, the tangential latching hook 23, which acts in a circumferential direction U, prevents the spring cover 15 from coming away from the belt pulley 11. To ensure that the radial latching hook 21 does not break during assembly, it is designed so that the overlap of the contour of the elongate hole 19 is limited to a maximum of 1 mm.

Rotational retention pins 25 are furthermore formed on the spring cover 15, said pins being arranged in the region of the latching elements 17 and likewise being passed through the elongate holes 19 in axial direction A. In this arrangement, each radial latching hook 21 is positioned between a tangential latching hook 23 and a rotational retention pin 25. By means of its abutment against the wall of the elongate hole 19, the rotational retention pin 25 prevents rotation of the spring cover 15 relative to the belt pulley 11. In contrast to the rotational retention pin 25, the tangential latching hook 23 does not rest against the wall of the elongate hole 19, and the tangential latching hook 23 overlaps the elongate hole 19 less than the radial latching hook 21.

To ensure that rotation of the spring cover 15 both in the clockwise and in the counterclockwise direction is prevented, at least two rotational retention pins 25 are required, acting in opposite directions. For this reason, an even number of latching elements 17 with rotational retention pins 25 is provided on the spring cover 15 and an even number of elongate holes 19 is provided on the belt pulley 11, with in each case two such snap joints being positioned close together spatially and being arranged in mirror symmetry about a radial axis R. This arrangement is shown in FIG. 1. One of the rotational retention pins 25 of such a group of two acts in the clockwise direction and the other rotational retention pin 25 acts in the counterclockwise direction.

It is also possible, in the case of two snap joints grouped together, for the positions of the tangential latching hooks 23 to be interchanged with those of the rotational retention pins 25. In this case, the rotational retention pins 25 are arranged closer to the radial axis R but nevertheless act in opposite directions and thus reliably prevent rotation of the spring cover 15.

LIST OF REFERENCE SIGNS

1 device
3 stator
5 rotor
7 front cover disk
9 rear cover disk
10 screw
11 belt pulley
13 spring
15 spring cover
17 latching elements
19 elongate hole
21 radial latching hook
23 tangential latching hook
25 rotational retention pin
A axial direction
R axis
U circumferential direction

The invention claimed is:

1. A device for varying the timing of gas exchange valves of an internal combustion engine, comprising a stator and a rotor accommodated therein, which is adjustable in a circumferential direction (U) relative to the stator by a pressure medium, wherein the rotor is adapted to be connected to a camshaft, a front cover disk and a rear cover disk, between which the stator and the rotor are accommodated, the rear cover disk is provided with a drive wheel that is adapted to be connected to a crankshaft, a spring for rotating the rotor relative to the stator, the spring is arranged between the rear cover disk and a spring cover wherein latching elements are provided on the spring cover and receptacles for the latching elements are provided on the drive wheel, the latching elements comprising a radial latching hook for radial engagement with the drive wheel and tangential latching hook for engagement with the drive wheel in a circumferential direction, and the spring cover is secured on a side of the drive wheel.

2. The device as claimed in claim 1, wherein the receptacles are elongate holes.

3. The device as claimed in claim 1, wherein the radial latching hook overlaps a contour of the receptacle by no more than 1 mm.

4. The device as claimed in claim 1, wherein the radial latching hook is larger than the tangential latching hook.

5. The device as claimed in claim 1, wherein rotational retention pins are provided on the spring cover.

6. The device as claimed in claim 5, wherein at least one of the rotational retention pins is arranged adjoining the latching element.

7. The device as claimed in claim 1, wherein each of the radial latching hooks is arranged between one of the tangential latching hooks and a rotational retention pin provided on the spring cover.

8. The device as claimed in claim 7, further comprising a second rotational retention pin wherein the two rotational retention pins are arranged in mirror symmetry about a radial axis (R) with respect to the radial latching hooks.

9. The device as claimed in claim 1, wherein the spring cover is made of plastic.

10. The device as claimed in claim 1, wherein the latching elements of the spring cover engage against a front side of the drive wheel.

11. A device for varying the timing of gas exchange valves of an internal combustion engine, comprising:

a stator and a rotor accommodated therein, which is adjustable in a circumferential direction relative to the stator by a pressure medium, wherein the rotor is adapted to be connected to a camshaft, a front cover disk and a rear cover disk, between which the stator and the rotor are accommodated, the rear cover disk is provided with a drive wheel that is adapted to be connected to a crankshaft, a spring for rotating the rotor relative to the stator, the spring is arranged between the rear cover disk and a spring cover, wherein a latching element is provided on the spring cover and a receptacle for the latching element is provided on the drive wheel, the latching element comprising a tangential latching hook for engagement with the drive wheel in a circumferential direction.

* * * * *